US006065564A

United States Patent [19]

Uegane

[11] Patent Number: 6,065,564

[45] Date of Patent: May 23, 2000

[54] VALVE APPARATUS FOR MUFFLER

[75] Inventor: Masayuki Uegane, Tochigi-ken, Japan

[73] Assignee: Honda Giken Kogyo Kabushiki Kaisha, Tokyo, Japan

[21] Appl. No.: 09/447,220

[22] Filed: Nov. 23, 1999

[51] Int. Cl.[7] ..... F16K 17/00

[52] U.S. Cl. ..... 181/237

[58] Field of Search ..... 181/237, 241, 181/253, 254, 265, 269, 272, 282

[56] References Cited

U.S. PATENT DOCUMENTS 5,739,483 4/1998 Yashiro et al. ..... 181/254
5,971,098 10/1999 Suzuki et al. ..... 181/254

*Primary Examiner*—Khanh Dang
*Attorney, Agent, or Firm*—Armstrong, Westerman, Hattori, McLeland & Naughton

[57] ABSTRACT

To a housing having a valve opening which serves as a bypass passage for exhaust gases, there is fixed one end portion of a plate valve which is capable of elastic deformation by deflection. The housing is provided with an enclosing wall which projects in a direction of opening of the plate valve in a manner to enclose the plate valve. A valve opening is formed by an inner peripheral space of the enclosing wall. When the exhaust gas pressure exceeds a predetermined pressure, the plate valve is deformed to a position beyond the open end of the enclosing wall, whereby the valve opening is opened to passage. A plate spring to contact the plate valve is provided. With an increase in the amount of deflection in the opening direction, the position of contact of the plate spring deviates toward a fixing end of the plate valve. The bending moment to be applied to the plate valve in a closing direction decreases.

5 Claims, 3 Drawing Sheets

VALVE APPARATUS FOR MUFFLER

BACKGROUND OF THE INVENTION

1. Field of the Invention

The present invention relates to a valve apparatus for a muffler (or a noise silencer) which is interposed in an exhaust system mainly of an internal combustion engine of a motor vehicle. It relates, in particular, to a valve apparatus which opens a bypass passage for exhaust gases inside the muffler when an exhaust gas pressure inside the muffler has risen to a predetermined pressure.

2. Description of the Related Art

The applicant of the present application has earlier proposed the following valve apparatus for a muffler in Japanese Patent Application No. 110580/1998. Namely, the valve apparatus is provided with a housing which has a valve opening through which the exhaust gases pass, and a valve which opens and closes the valve opening. The valve is constituted by a plate valve which is capable of elastic deformation by deflection (or flexure) and one end portion of which is fixed to the housing. A valve seat is provided in the periphery of the valve opening on that surface of the housing to which the plate valve is fixed. The plate valve is caused to be seated on the valve seat in a state of being urged in a closing direction (i.e., a direction in which the plate valve is closed) by the elastic restoring force due to its own deformation by deflection. When an exhaust gas pressure exceeding this elastic restoring force is operated on the plate valve, the plate valve is deflected in an opening direction (i.e., a direction in which the plate valve is opened), whereby the valve opening is opened to passage.

However, the above-described apparatus has the following disadvantages. Namely, when the plate valve returns in the closing direction by the elastic restoring force when the exhaust gas pressure has decreased, the plate valve strikes the valve seat, resulting in consequent striking noises as well as wear on both the plate valve and the valve seat.

The present invention has an object of providing a valve apparatus for a muffler in which the above-described disadvantages has been resolved.

SUMMARY OF THE INVENTION

In order to attain the above and other objects, the present invention is a valve apparatus for a muffler, the valve apparatus operating to open a bypass passage for exhaust gases inside the muffler when an exhaust gas pressure has increased to a predetermined pressure. The valve apparatus comprises: a housing having a valve opening for the exhaust gases to flow therethrough; a valve for opening and closing the valve opening, the valve being constituted by a plate valve which is capable of elastic deformation by deflection and one end portion of which is fixed to the housing; an enclosing wall provided in the housing in a manner to project in an opening direction of the plate valve so as to enclose the plate valve, wherein the valve opening is constituted by an inner peripheral space of the enclosing wall such that, when the exhaust gas pressure has exceeded a predetermined pressure, the plate valve is deformed by deflection to a position beyond an open end of the enclosing wall, whereby the valve opening is opened to passage.

According to this arrangement, while securing the function of opening the bypass passage at the time of the increase in the exhaust gas pressure to the predetermined pressure, a valve seat portion on which the plate valve is seated can be deleted. As a result, there can be prevented the striking noises and the wear which occur by the striking at the valve seat portion when the plate valve returns in the closing direction.

By the way, when the exhaust gas pressure is of such a degree as to slightly open the plate valve by the exhaust gas pressure, the degree of opening, if any, of the plate valve is small even if it has been opened. Therefore, the amount of exhaust gases to flow though the plate valve is small and, consequently, such a dynamic pressure by the exhaust gas flow as is sufficient to maintain the opening of the plate valve does not operate on the plate valve, whereby the plate valve is closed. Thereafter, the plate valve is opened again by the static pressure of the exhaust gases. The operation of opening and closing of the plate valve is thus repeated, resulting in vibrations accompanied by the opening and closing movements. Once this kind of vibrations accompanied by the opening and closing movements occur, the amount of damping of the exhaust gases fluctuates. As a result, the stable silencing effect cannot be obtained.

In such a case, it is preferable to provide urging means for urging the plate valve in the closing direction. Preferably, the urging means is constituted such that a bending moment in the closing direction to be applied by an urging force of the urging means to the plate valve decreases with an increase in an amount of deflection of the plate valve in the opening direction. According to this arrangement, when the plate valve begins to be deflected in the opening direction as a result of an increase in the exhaust gas pressure, the bending moment in the closing direction to be applied by the urging means decreases. The plate valve thus opens at a stretch or rapidly. On the other hand, when the plate valve begins to restore in the closing direction as a result of a decrease in the exhaust gas pressure, the bending moment in the closing direction to be applied by the urging means increases. The plate valve thus closes at a stretch or rapidly. In this manner, the plate valve can be switched between the opened state and the closed state instantly and does not repeat the opening and closing operations in a transient state. As a consequence, the opening and closing vibrations of the plate valve can be effectively restrained and a stable silencing effect can be obtained.

Preferably, the urging means is made of a plate spring whose one end contacts that surface of the plate valve which faces the opening direction thereof, and the plate spring contacts the surface in an inclined posture such that, with an increase in an amount of deflection in the opening direction of the plate valve, a position of contact of the plate spring with the plate valve deviates in a direction toward the above-described one end portion of the plate valve. In this arrangement, the urging means can be constituted only by the plate spring, and the construction of the valve apparatus can be simplified.

In addition, preferably the valve apparatus further comprises a stopper member which restrains the deflection in the opening direction of the plate valve up to a given position, an opposite end of the plate spring being fixed to the stopper member so that the stopper member serves the dual purpose as a mounting bracket for the plate spring. Here, the stopper member is formed into a shape in which the stresses on the plate valve can be appropriately dispersed. If the plate spring is interposed between the plate valve and the stopper member, when the plate valve comes into contact with the stopper member, the plate valve will no longer contact the stopper member in strict accordance with the shape of the stopper member. As a result, the effect of dispersing the stresses will be lessened. In such a case, the stopper member preferably has formed therein an opening which contains therein the plate spring when the plate valve comes into contact with the stopper member. In this arrangement, the plate valve comes into direct contact with the stopper member without intervening the plate valve therebetween. The effect of dispersing the stresses can thus be fully attained. The durability of the plate valve can be improved.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
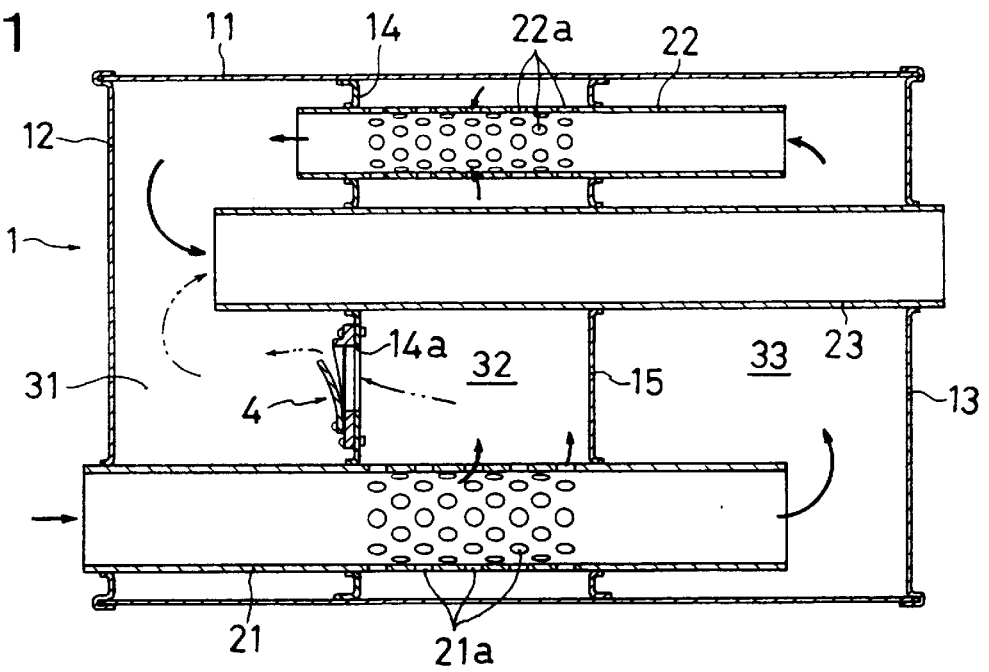
FIG. 1 is a sectional view of one example of a muffler provided with a valve apparatus of the present invention.

With reference to FIG. 1, reference numeral 1 denotes a muffler (or a noise silencer) which is interposed in an intermediate portion of an exhaust system of an internal combustion engine. A main body of the muffler (also called a muffler main body) is made up of a shell 11 of a cylindrical shape, and first and second end walls 12, 13 which close one end and the other end of the shell 11, respectively. A pair of, i.e., first and second, separators (or partition walls) 14, 15 are provided inside the muffler main body to thereby divide the space inside the muffler main body into a first silencer chamber 31 which lies between the first end wall 12 and the first separator 14, a second silencer chamber 32 which lies between the first separator 14 and the second separator 15, and a third silencer chamber 33 which lies between the second separator 15 and the second end wall 13. Further, the muffler 1 is provided with the following three tubes: i.e., an exhaust gas inlet tube 21 which penetrates through the first end wall 12, the first separator 14 and the second separator 15, respectively, and comes into communication with the third silencer chamber 33; an inner tube 22 which penetrates through the second separator 15 and the first separator 14, respectively, to bring the third silencer chamber 33 and the first silencer chamber 31 into communication with each other; and an exhaust gas outlet tube 23 which penetrates through the second end wall 13, the second separator 15 and the first separator 14, respectively, and comes into communication with the first silencer chamber 31. A tube wall of that portion of the exhaust gas inlet tube 21 which lies inside the second silencer chamber 32 is provided with a large number of perforations 21*a*. A tube wall of that portion of the inner tube 22 which lies inside the second silencer chamber 32 is also provided with a large number of perforations 22*a*. It is thus so arranged that the exhaust gas inlet tube 21 and the inner tube 22 are brought into communication with each other through the second silencer chamber 32.

According to this arrangement, the flow passage of the exhaust gases that flow into the exhaust gas inlet tube 21 will be made up of the following two flow channels; one is through the third silencer chamber 33, the inner tube 22 and the first silencer chamber 31 to the exhaust gas outlet tube 23, and the other is through the perforations 21*a*, the second silencer chamber 32, the perforations 22*a*, the inner tube 22 and the first silencer chamber 31 to the exhaust gas outlet tube 23.

When a large amount of exhaust gases have flown into the exhaust gas inlet tube 21 accompanied by a higher rotational speed of the internal combustion engine, the above-described two flow channels alone will result in a higher exhaust gas pressure in the silencer chambers 32, 33, as well as in a consequent decrease in the output of the internal combustion engine.

As a solution to this problem, the first separator 14 is provided with an opening 14*a* as a bypass passage which brings the second silencer chamber 32 and the first silencer chamber 31 into communication with each other. This opening 14*a* is provided with a valve apparatus 4 which opens the bypass passage when the exhaust gas pressure has risen to a predetermined pressure. It is thus so arranged that, in a region of a high-speed rotation of the internal combustion engine, a large amount of exhaust gases can be smoothly exhausted into the atmosphere through the above-described two flow channels as well as the flow channel of the bypass passage, i.e., through a total of three flow channels.

Figure 2A:
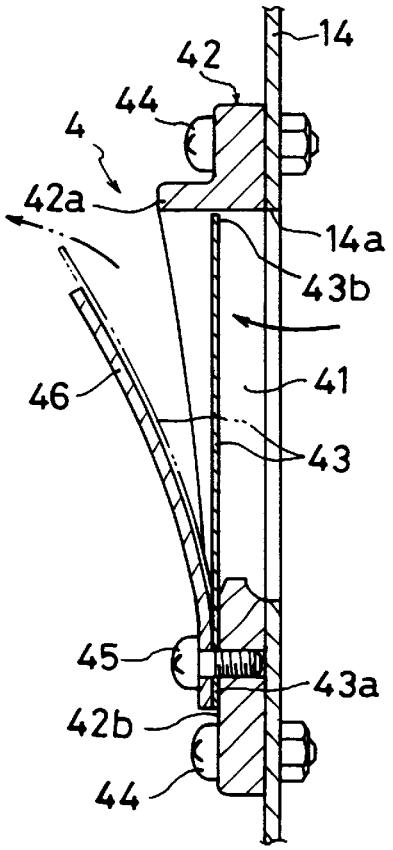
FIG. 2A is a sectional view of a first embodiment of the valve apparatus of the present invention and FIG. 2B is a left side view thereof.
Figure 2B:
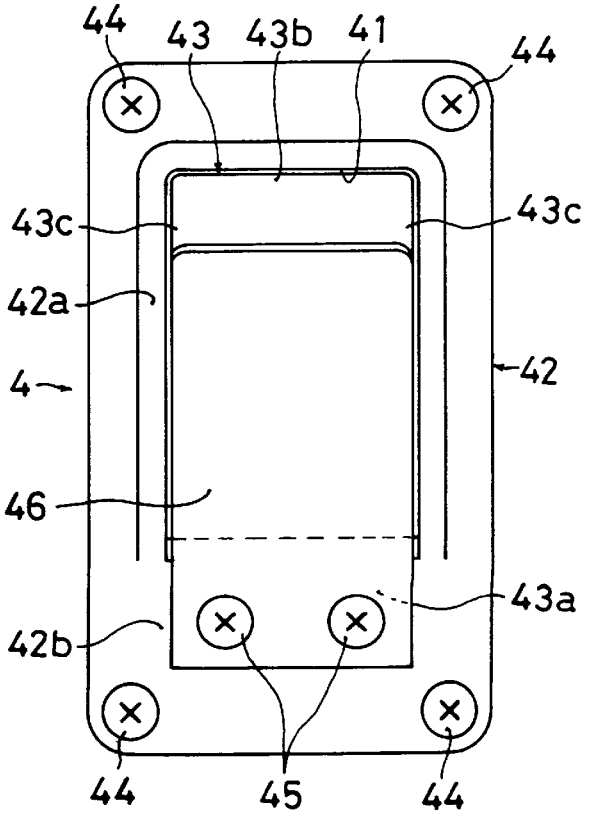

The valve apparatus 4 is made up, as shown in FIGS. 2A and 2B, of a housing 42 having a valve opening 41, and a plate valve (or a valve in the shape of a plate) 43 which opens and closes the valve opening 41 and which is capable of being elastically deformed by deflection. The housing 42 is fixed with screws 44 to the first separator 14 in such a manner that the valve opening 41 coincides with the above-described opening 14*a*.

The housing 42 is formed by a square material which is made of a forged product or a cast product. The housing 42 is provided with the valve opening 41 in the center thereof and a valve fixing portion 42*b* which lies adjacent to the valve opening 41. One end potion 43*a* of the plate valve 43 is fixed to the valve fixing portion 42*b* with screws 45. The housing 42 is provided with an approximately U-shaped enclosing wall 42*a* which encloses a peripheral edge of the plate valve 43 exclusive of the above-described one end portion 43*a*, i.e., the enclosing wall 42*a* enclosing an opposite end portion 43*b* and both side edge portions 43*c*, 43*c* of the plate valve 43. This enclosing wall 42*a* is arranged to project or extend from the surface of the housing 42 in the opening direction of the plate valve 43. The valve opening 41 is thus constituted by an inner peripheral space of this enclosing wall 42*a*. Further, the open end (or the free edge which is opposite to the end which is fixed to the first separator 14) of the enclosing wall 42*a* is formed into a curve which is the same as a curve to be formed when the plate valve 43 is deflected by a predetermined amount in the opening direction thereof.

A space is secured between the inner peripheral surface of the enclosing wall 42*a* and the peripheral edge of the plate valve 43 in order to prevent the occurrence of gouging or scratching during the opening and closing operation of the plate valve 43. Since the width of this space is small, as long as the plate valve 43 is located within a space to be enclosed by the enclosing wall 42*a*, i.e., within the valve opening 41, the flow of the exhaust gases through the valve opening 41 can be substantially shut off.

A stopper member 46 for restricting the deflection of the plate valve 43 in the opening direction is fixed to the housing 42 together with the plate valve 43 with the above-described screws 45. The plate valve 43 is thus prevented from being excessively deflected in the opening direction.

According to the above arrangement, the plate valve 43 is deflected under the influence of the exhaust gas pressure in the second silencer chamber 32. However, while the exhaust gas pressure is low, the plate valve 43 is positioned within the valve opening 41, whereby the valve opening 41 remains substantially closed. Once the exhaust gas pressure inside the second silencer chamber 32 has risen to a predetermined pressure, the plate valve 43 is deflected to a position beyond the open end of the enclosing wall 42*a*. As a result, the valve opening 41 is opened to passage, so that the exhaust gases flow through the bypass passage.

Figure 3A:
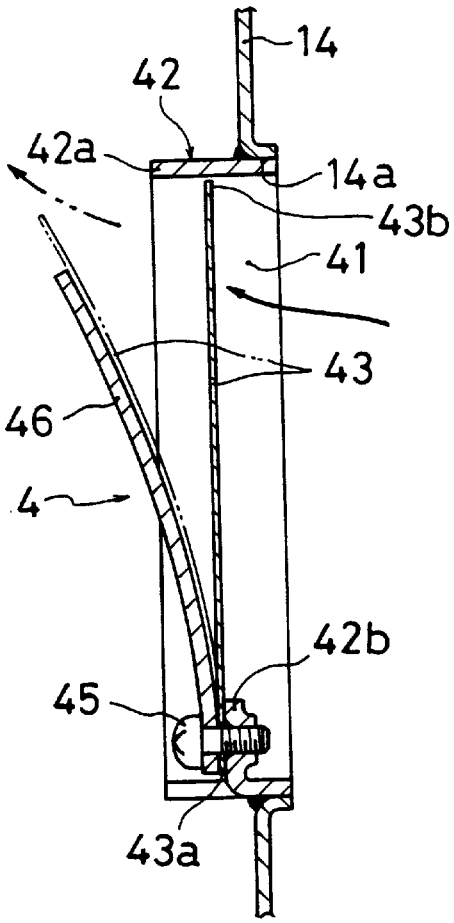
FIG. 3A is a sectional view of a second embodiment of the valve apparatus of the present invention and FIG. 3B is a perspective view of the valve housing to be used in the second embodiment.
Figure 3B:
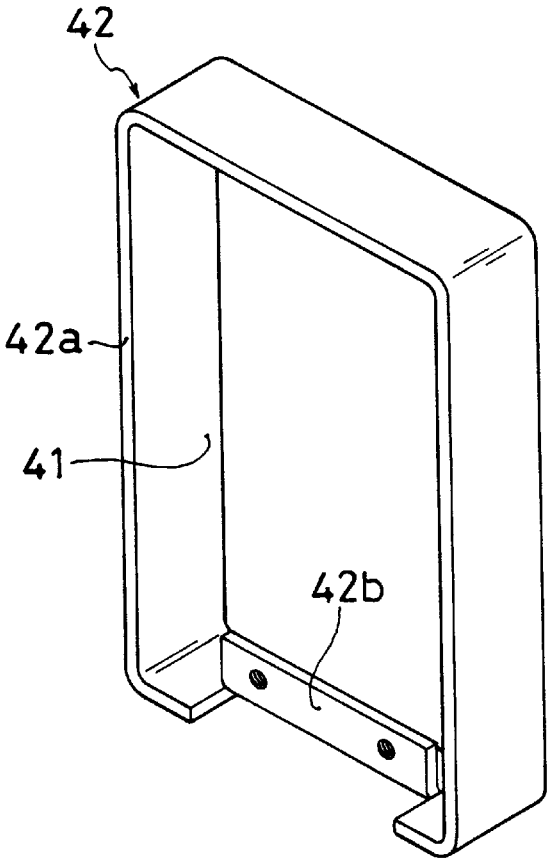

In the above-described first embodiment, the housing 42 is made of a cast product or a forged product. As a second embodiment of the present invention, the housing 42 may also be made, as shown in FIGS. 3A and 3B, by slicing a square pipe into a required depth. This embodiment has an advantage in that the cost and weight of the valve apparatus can be reduced.

In this second embodiment, one side portion of one of the open ends of the square pipe housing 42 is partially cut and bent inward substantially at right angles to form the valve fixing portion 42*b*. The plate valve 43 and the stopper member 46 are fixed together to this valve fixing portion 42*b* with the screws 45. The enclosing wall 42 to enclose the plate valve 43 is thus formed by a pipe wall, except for the valve fixing portion 42*b*, of the housing 42. The housing 42 is fitted into, and welded to, the opening 14*a* in the first separator 14 by utilizing the other of the open ends of the housing 42.

Figure 4A:
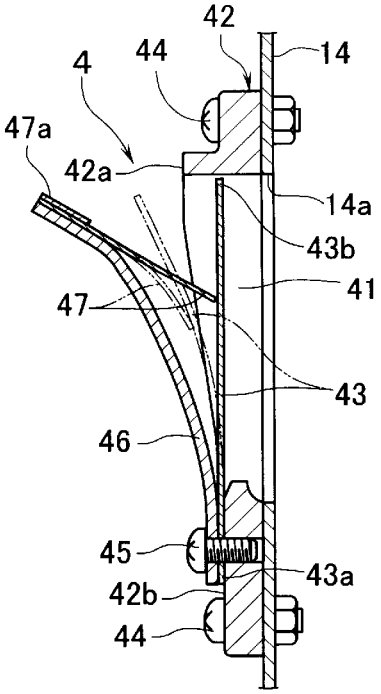
FIG. 4A is a sectional view of a third embodiment of the valve apparatus of the present invention and FIG. 4B is a left side view thereof.
Figure 4B:
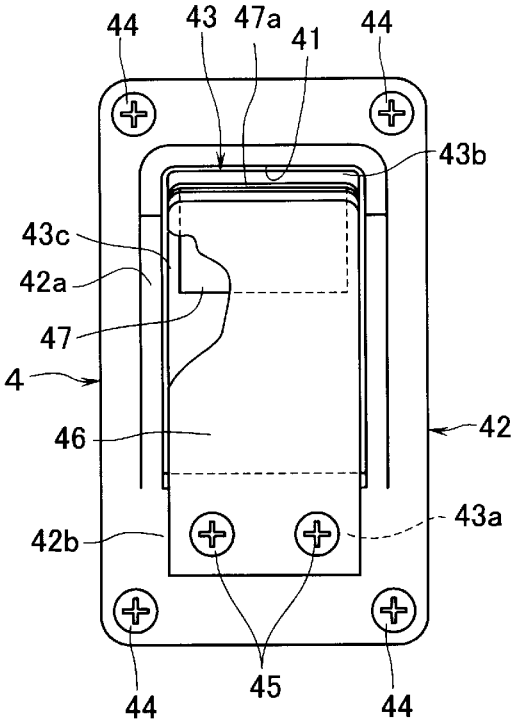

FIGS. 4A and 4B show a third embodiment of the present invention. In this embodiment, the same numerals as in the first embodiment are affixed to the same members as in the first embodiment. In this third embodiment, there is further provided a plate spring 47 which functions as an urging means to urge the plate valve 43 in the closing direction. In a manner to cause the plate spring 47 to contact, at one end thereof, that surface of the plate valve 43 which faces the opening direction thereof, the plate spring 47 is fixed, at the other end thereof, to the stopper member 46. The plate spring 47 is arranged to contact the plate valve 43 in a posture inclined toward one end 43*a*, which is a fixed end, of the plate valve 43. With an increase in the amount of deflection of the plate valve 43 in the opening direction, the position of contact of the plate spring 47 with the plate valve 43 is thus arranged to deviate toward the above-described one end 43*a* of the plate valve 43.

Here, the plate valve 43 is subjected to a bending moment in the closing direction by the urging force of the plate spring 47. While the position of contact of the plate spring 47 with the plate valve 43 deviates as described above, the urging force of the plate spring 47 does not vary much. It follows that the bending moment to be applied to the plate valve 43 in the closing direction decreases with an increase in the amount of deflection of the plate valve 43 in the opening direction. Therefore, when the plate valve 43 starts deflection in the opening direction with an increase in the exhaust gas pressure, the bending moment to be applied by the plate spring 47 in the closing direction decreases and, as a consequence, the plate valve 43 will be opened at a stretch or rapidly. On the other hand, when the plate valve 43 starts deflection in the closing direction with a decrease in the exhaust gas pressure, the bending moment in the closing direction to be applied by the plate spring 47 increases and, as a consequence, the plate valve 43 will be closed at a stretch or rapidly. In this manner, since the plate valve 43 is switched between the opened state and the closed state instantly or very quickly, the closing and opening operations in a transient state will not be repeated. The vibrations accompanied by the opening and closing operations of the plate spring 47 can thus be restrained.

The plate spring 47 is fixed at the other end thereof to the front end of the stopper member 46 by spot welding or the like in a state in which a retainer 47*a* of a plate shape is attached to the outside surface of the plate spring 47. The concentration of stresses on the fixing point of the plate spring 47 is prevented by the retainer 47*a* to thereby improve the durability. In the present embodiment, the plate valve 43 and the plate spring 47 are made of the same material (e.g., a high-temperature and high-strength nickel base alloy called "INC0718"). The plate thickness of the plate valve 43 is set to, e.g., 0.15 mm, and that of the plate spring 47 to, e.g., 0.10 mm. The reason why the plate thickness of the plate valve 43 is larger than that of the plate spring 47 is to prevent the plate valve 43 from being bent at the point of contact of the plate spring 47 with the plate valve 43.

Figure 5A:
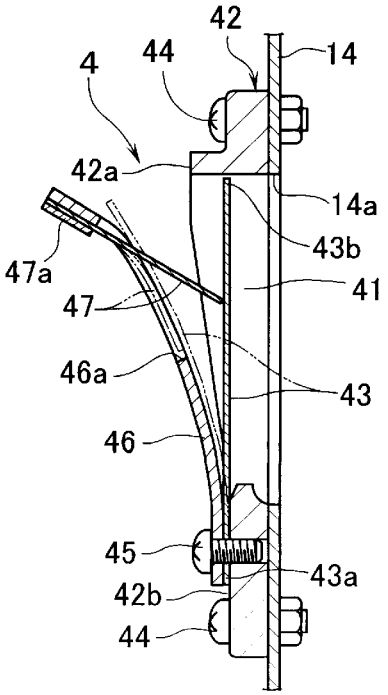
FIG. 5A is a sectional view of a fourth embodiment of the valve apparatus of the present invention and FIG. 5B is a left side view thereof.
Figure 5B:
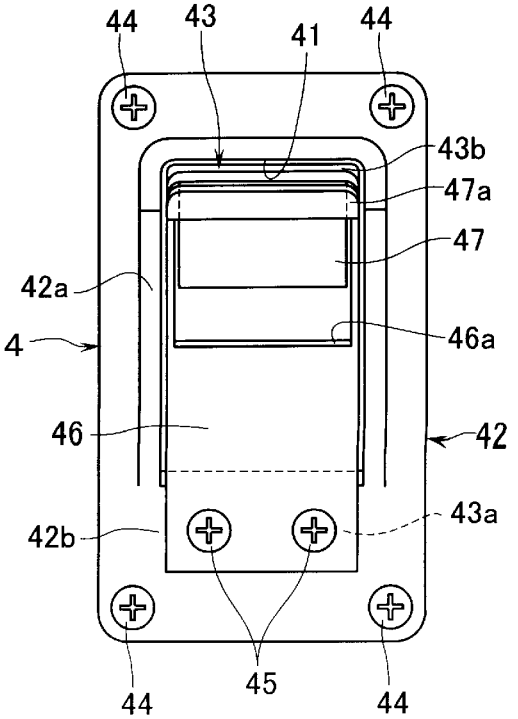

FIGS. 5A and 5B show a fourth embodiment of the present invention. In this embodiment, the same numerals as in the third embodiment are affixed to the same members as in the third embodiment. In the fourth embodiment, the other end of the plate spring 47 is fixed to the rear surface (i.e., the surface which lies in the opening direction of the plate valve 43) at the front end of the stopper member 46. The stopper member 46 is provided with an opening 46*a* into which the plate spring 47 is contained when the plate valve 43 comes into contact with the stopper member 46.

In the third embodiment, the plate valve 43 contacts the stopper member 46 in a state in which the plate spring 47 is held or interposed between the plate valve 43 and the stopper member 46. On the other hand, in the fourth embodiment, the plate valve 43 comes into direct contact with the stopper member 46 without the presence of the plate spring 47 in between. The stopper member 46 is formed into a shape in which the stresses on the plate valve 43 can be appropriately dispersed. In the third embodiment, however, since the plate spring 47 is interposed between the plate valve 43 and the stopper member 46, the plate valve 43 does not contact the stopper member 46 strictly according to the shape of the stopper member 46. The effect of dispersing the stresses can thus be weakened. In the fourth embodiment, on the other hand, since the plate valve 43 comes into direct contact with the stopper member 46, the effect of dispersing the stresses can be fully obtained. The durability of the plate valve 43 can thus be improved.

It is readily apparent that the above-described valve apparatus for a muffler meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A valve apparatus for a muffler, said valve apparatus operating to open a bypass passage for exhaust gases inside the muffler when an exhaust gas pressure has increased to a predetermined pressure, said valve apparatus comprising:

a housing having a valve opening for the exhaust gases to flow therethrough;

a valve for opening and closing the valve opening, said valve being constituted by a plate valve which is capable of elastic deformation by deflection and one end portion of which is fixed to said housing;

an enclosing wall provided in said housing in a manner to project in an opening direction of said plate valve so as to enclose said plate valve, wherein said valve opening is constituted by an inner peripheral space of said enclosing wall such that, when the exhaust gas pressure has exceeded a predetermined pressure, said plate valve is deformed by deflection to a position beyond an open end of said enclosing wall, whereby said valve opening is opened to passage.

2. A valve apparatus for a muffler according to claim 1, further comprising urging means for urging said plate valve in a closing direction.

3. A valve apparatus for a muffler according to claim 2, wherein said urging means is constituted such that a bending moment in the closing direction to be applied by an urging force of said urging means to said plate valve decreases with an increase in an amount of deflection of said plate valve in the opening direction.

4. A valve apparatus for a muffler according to claim 3, wherein said urging means is made of a plate spring whose one end contacts that surface of said plate valve which faces the opening direction thereof, and wherein said plate spring contacts said surface in an inclined posture such that, with an increase in an amount of deflection of said plate valve in the opening direction, a position of contact of said plate spring with said plate valve deviates in a direction toward said one end portion of said plate valve.

5. A valve apparatus for a muffler according to claim 4, further comprising a stopper member which restrains the deflection in the opening direction of said plate valve up to a given position, an opposite end of said plate spring being fixed to said stopper member, wherein said stopper member has formed therein an opening which contains therein said plate spring when said plate valve comes into contact with said stopper member.

* * * * *

UNITED STATES PATENT AND TRADEMARK OFFICE

CERTIFICATE OF CORRECTION

PATENT NO.: 6,065,564
DATED : May 23, 2000
INVENTOR(S): Masayuki UEGANE

It is certified that an error appears in the above-identified patent and that said Letters Patent is hereby corrected as shown below:

On the title page of the patent insert item --[30] Foreign Application Priority Data October 21, 1999 [JP] Japan .....299430--

Signed and Sealed this

Ninth Day of January, 2001

*Attest:*

Q. TODD DICKINSON

*Attesting Officer*

*Commissioner of Patents and Trademarks*